United States Patent [19]

Lay

[11] 4,339,219

[45] Jul. 13, 1982

[54] PANEL RAISING AND POSITIONING APPARATUS

[76] Inventor: Harry V. Lay, General Delivery, Kernville, Calif. 93228

[21] Appl. No.: 174,120

[22] Filed: Jul. 31, 1980

[51] Int. Cl.[3] ..... E04G 21/14

[52] U.S. Cl. ..... 414/11; 254/4 C

[58] Field of Search ..... 414/10, 11, 12, 590; 254/3 R, 3 C, 4 R, 4 C

[56] References Cited

U.S. PATENT DOCUMENTS

| | | | |
|---|---|---|---|
| 1,639,962 | 8/1927 | Pfiffner | 414/10 |
| 2,815,132 | 12/1957 | Stone | 414/11 |
| 2,815,251 | 12/1957 | Stone | 414/11 X |
| 2,828,870 | 4/1958 | Corley | 414/11 |
| 3,028,978 | 4/1962 | Dickens | 414/11 |
| 3,131,907 | 5/1964 | Brown | 254/4 R |
| 3,305,219 | 2/1967 | Rhodes | 414/11 |
| 3,317,059 | 5/1967 | Higgins | 414/11 |
| 3,467,261 | 9/1969 | Jewell | 414/11 |
| 3,643,935 | 2/1972 | Bell | 414/10 X |
| 3,871,477 | 3/1975 | Kuest | 414/11 X |

*Primary Examiner*—Leslie J. Paperner

*Attorney, Agent, or Firm*—Fulwider, Patton, Rieber, Lee & Utecht

[57] ABSTRACT

An apparatus for raising and positioning panels to be attached to the interior surface of a building. It includes a movable frame having a pair of telescoping stanchions, whereby its height can be varied, and a panel holder pivotably mounted atop the frame. The ceiling panel is loaded with the holder in a generally vertical position alongside the frame and then swung into a horizontal working position. A hanger can be mounted on one end of the frame to support a wall panel in a generally vertical working position.

1 Claim, 6 Drawing Figures

PANEL RAISING AND POSITIONING APPARATUS

FIELD OF THE INVENTION

The present invention relates to apparatus for raising and positioning panels, and, more particularly, to such apparatus for use when securing panels to the interior surfaces of a building.

BACKGROUND OF THE INVENTION

In the construction of a building, it is common practice to use panels, such as dry-wall, to form the interior surfaces of the walls and ceilings. Typically, these panels are large and heavy but cannot withstand rough treatment without being broken or otherwise damaged. Positioning these panels and holding them while they are secured by nails or otherwise is, therefore, a difficult problem. Two workers are usually required, and even then, the ceiling panels are particularly hard to handle. The job is time-consuming and adds significantly to the cost of some construction projects. Moreover, the difficulty of holding the panels in position while they are secured often results in misalignment.

It is an objective of the present invention to provide an apparatus that enables a single worker to efficiently position and hold such panels while they are attached. A further objective is to provide such an apparatus that is compact so that it can be easily moved about the interior of the building and which is disassemblable so that it can be readily transported. Still another objective is to provide such an apparatus that can be used in connection with both ceiling panels and wall panels.

SUMMARY OF THE INVENTION

In accordance with the present invention, an apparatus for raising and positioning a panel for attachment to the interior surface of a building comprises a movable frame and a panel holder pivotably mounted atop the frame. The frame includes a pair of stanchions, each having at least two telescoping members whereby its height can be varied. The panel holder can be swung between a generally vertical loading position and a generally horizontal working position.

In one embodiment of the invention, supports are provided to receive the lower edge of the panel in the loading position, these supports being movable to a non-engaging position once the panel and holder have been moved to the working position. Rollers are provided on the holder that enable the panel to be shifted when in its working position to achieve precise alignment. Other features that can be included in the invention are horizontally extensible feet to which the stanchions are attached and a detachable center section that extends between the stanchions. A crank can be provided for expanding and contracting the stanchions.

Another aspect of the invention relates to a removable hanger that can be mounted on the holder to support a panel in a vertical working position for attachment to a wall. The hanger can then be raised or lowered by extending or contracting the stanchions.

These and other advantages of the present invention will be apparent from the following detailed description, taken in conjunction with the accompanying drawings which illustrate, by way of example, the principles of the invention.

DESCRIPTION OF THE PREFERRED EMBODIMENT

Figure 1:
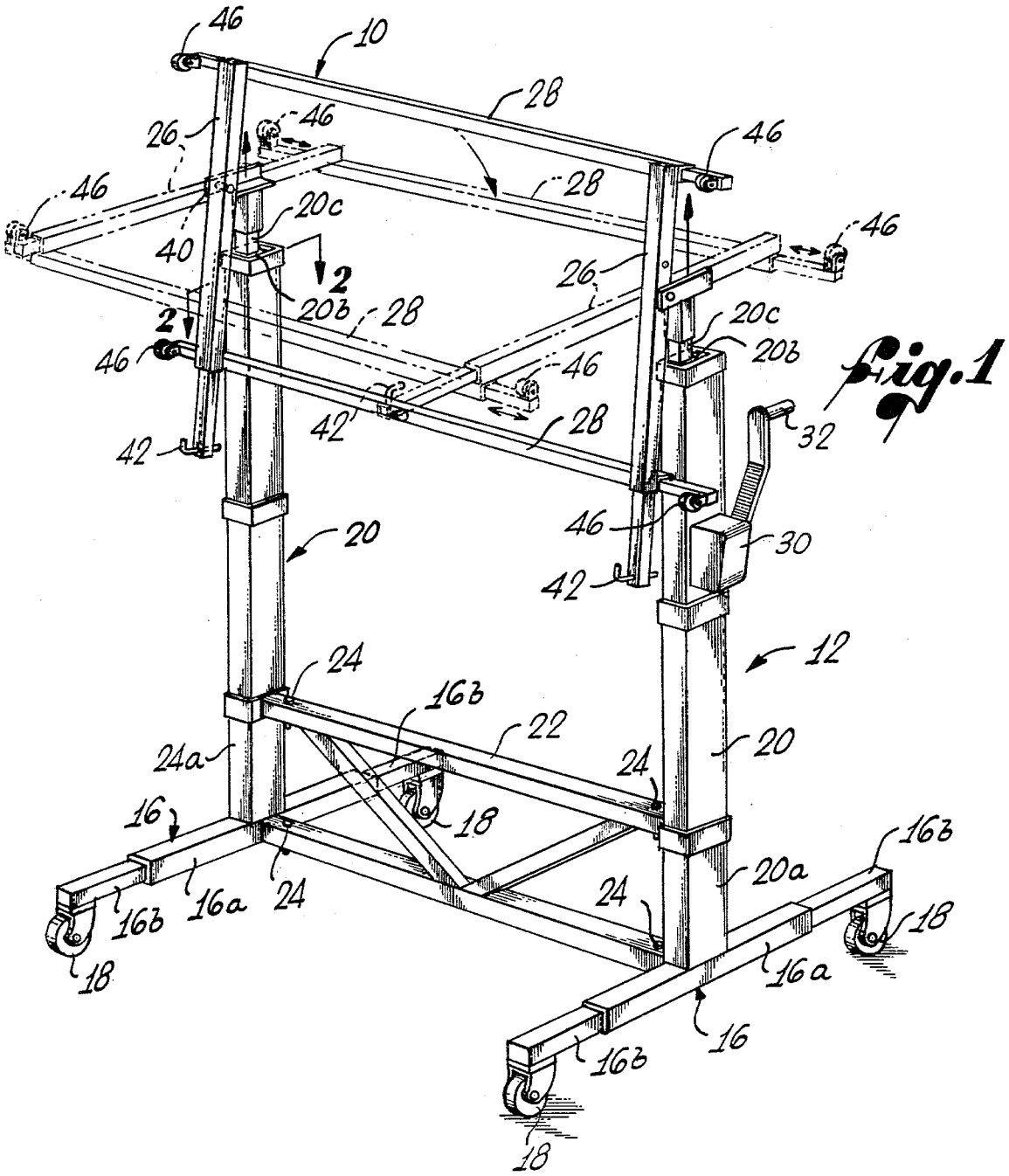
FIG. 1 is a perspective view of a panel raising and positioning apparatus constructed in accordance with the present invention, the panel holder being shown in solid lines in its loading position, and being shown in phantom lines in its working position.

An apparatus 10 for use in raising and lowering interior wall and ceiling panels P, such as plaster-board, includes a frame 12 and a holder 14. As seen in FIGS. 1, 4, 5 and 6, the frame 12 includes two parallel, spaced apart, horizontal foot members 16, each including a center portion **16*a* in which extender portions 16*b* are telescopically receivable in each end. The outer end of each extender 16*b* is supported by a caster 18, whereby the entire frame 12** is easily movable.

Figure 6:
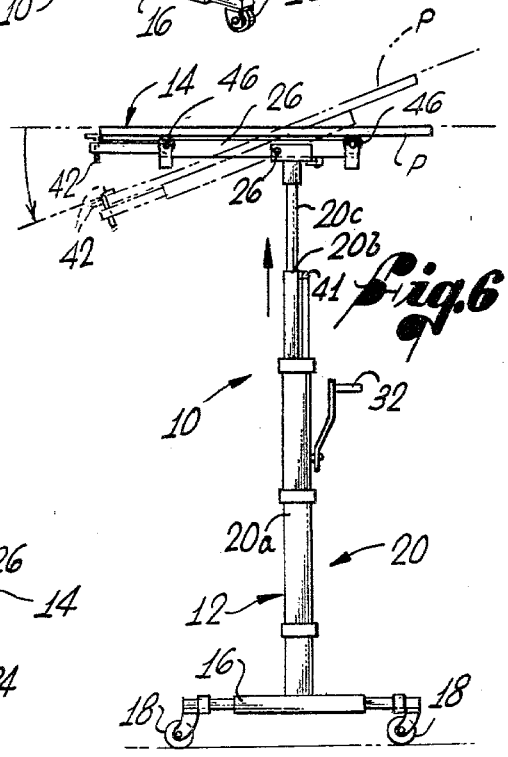
FIG. 6 is another elevation end view of the apparatus, with the stanchions extended vertically and the holder in its working position.

Extending upwardly from the center of each foot 16 is a vertically extensible stanchion 20, also of telescoping construction and movable between a vertically contracted position (shown in FIGS. 1, 4 and 5) and a vertically extended position (shown in FIG. 6). Each stanchion 20 has an outer member **20*a*, a middle member 20*b* and an inner member 20*c*. The outer member 20*a* is fixed permanently to the center portion 16*a* of the corresponding foot member 16. Joining the two stanchions 20 at their lower ends is a center section 22 that is removably secured to the stanchions by a plurality of fasteners 24**.

The holder 14 is formed by two end pieces 26 and two side pieces 28 connected in a rectangular configuration. The end and side pieces 26 and 28 of the holder 14 are also of a telescoping construction so that its effective dimensions can be increased by expanding these pieces outwardly from the corners of the rectangle that they form.

The end pieces 26 are each pivoted on pins 29 near their longitudinal centers atop the inside member **20*c* of a corresponding one of the stanchions 20. It is thus possible to swing the holder 14 between a generally vertical position on one side of the frame 12 (as shown in solid lines in FIG. 1 and in FIG. 5) and a generally horizontal position atop the frame (as shown in phantom lines in FIG. 1 and in FIG. 6), the pivot axis extending between the stanchions 20 and being perpendicular to the feet 16. When the holder 14 is in its horizontal position, the end-pieces 26 are parallel to the feet 16 and the side pieces 28 are parallel to the center section 22**.

Figure 3:
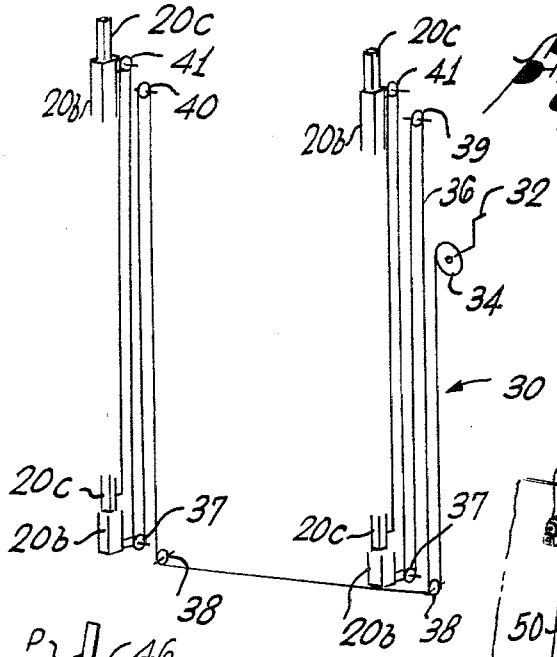
FIG. 3 is a schematic illustration of the crank mechanism of the invention.
Figure 4:
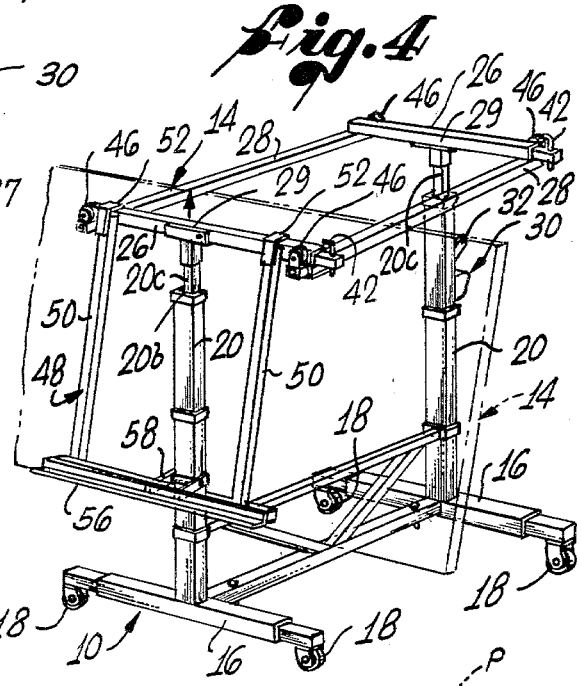
FIG. 4 is another perspective view of the apparatus, on a reduced scale, showing it with a hanger attachment in use, a panel being shown in phantom lines.
Figure 5:
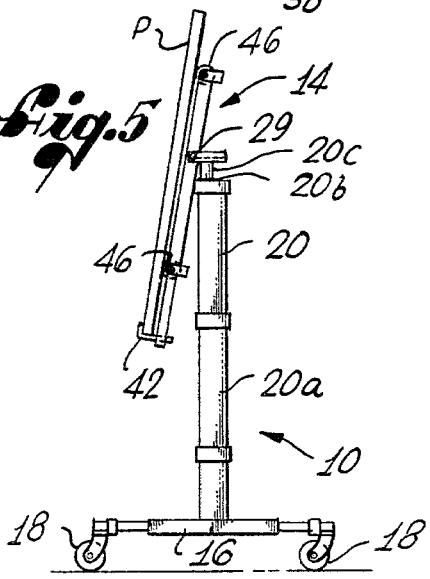
FIG. 5 is an elevational end view of the apparatus of FIG. 1 with the holder in its loading position.

A crank mechanism 30 for extending and contracting the stanchions 20, shown schematically in FIG. 3, includes a crank handle 32 mounted on one of the stanchions, as shown in FIG. 1. Secured to a reel 34 on the handle 32 is a cable 36 that extends around a pulley 38 at the bottom of one outer stanchion member **20*c* over a pulley 39 at the top of that outer stanchion member, around a pulley 40 on the bottom of the middle member 201, over a pulley 41 on the top of the outer member, and is secured to the lower end of the inner stanchion member 20***c*. Another cable 36' extends from reel 34 along the center section 22 to a similar set of pulleys within the other stanchion 20. Thus, by turning the crank handle 32 and shortening the cables 36 and 36', the middle and inner member 20*b* and 20*c* of the stanchions 20 are raised and the stanchions are extended. The holder 14, being mounted atop the inner members 20*c*, is raised in this way. The stanchions 20 can be contracted and the holder 14 lowered by turning the crank handle 32 in the opposite direction.

The operation of the apparatus 10 to position ceiling panels P is as follows. The stanchions 20 are fully contracted to bring the holder 14 into a position in which it is readily accessible to a worker standing on the floor. A pair of hook-like panel supports 42 on the lower ends of the end pieces 26 are positioned so that they extend outwardly to engage the bottom edge of a panel P placed in a generally vertical position. When the holder 14 is in this loading position, it is generally vertically but at a slight angle so that the panel P can be pushed back toward the stanchions 20 to rest securely against the holder 14. The holder 14, with the panel P, is then swung into a generally horizontal position (as shown in phantom lines in FIG. 1) and secured in that position by a pair of latches 44 (only one such latch being visible in FIG. 1). The panel P is then raised toward the ceiling by turning the crank handle 32 to elevate the holder 14. Before the panel P reaches its final position in which it rests against the ceiling (as shown in FIG. 6), the supports 42 are pivoted into non-engaging positions so that they do not interfere with the panel being held flush against the ceiling.

While in its horizontal working position, the panel P is supported by rollers 46 at the corners of the rectangle formed by the intersection of the side pieces 26 and the end pieces 28 of the holder 14. These rollers 46, in addition to being rotatable about a horizontal axis, are also rotatable about a vertical roller axis so that the panel P "floats". That is the panel P can be moved slightly in any direction to properly align and position it on the ceiling.

While most ceilings are horizontal, there are occasions in which it is desired to secure a panel P to an inclined ceiling. It should be noted that this condition can be accommodated by positioning the holder 14 at angle between its loading position and its normal working position (as shown in phantom lines in FIG. 6).

After aligning the panel P and securing it, usually by nails, the holder 14 is lowered and returned to the loading position of FIG. 1, and the apparatus 10 is rolled on its wheels 18 to the location where it will be used to position the next panel.

The same apparatus 10 can be used in connection with wall panels P. It should be noted, however, that even when the feet 16 are fully contracted, they extend beyond the holder 14 horizontally when the holder is in its loading position. This minimum length of the feet 16 is necessary to provide adequate stability for the apparatus 10 but makes it impossible to position a panel P held by the panel holder 14 against a wall.

To overcome this difficulty, a removable hanger 48 is provided. When using the hanger 48, the holder 14 is secured in its horizontal working position by the latch 44. The hanger 48 includes two arms 50 with hooks 52 on their upper ends by which it is suspended from either end piece 26 of the holder 14. At the bottom of the hanger 48, connecting the lower end of the arms 50, is a horizontal center piece 54 that carries an outwardly projecting lip 56. A brace 58 extends from the center piece 54 to rest against the nearer stanchion 20.

Since the brace 58 holds the bottom end of the hanger 48 slightly away from the nearer stanchion 20, the hanger assumes a slightly inclined position with respect to the vertical. Thus, it hangs on one end of the frame 12 extending across one stanchion 20, generally parallel to the foot members 16 and perpendicular to the rotational axis of the holder 14.

The panel P to be attached to the wall is supported by the lip 56 and rests against the hanger 48. The apparatus 10 is then moved on its wheels 18 until the bottom edge of the panel P is brought into proper position against the wall. The height of the panel P is adjustable by the operation of the crank mechanism 30 to vary the height of the stanchions 20, thereby controlling the vertical position of the hanger 48. Since the center piece 54 and supporting lip 56 of the hanger 48 are offset from the stanchion by the brace 56, the lower edge of the panel P is held away from the nearest foot 16 of the frame 12 and the foot does not interfere with the proper positioning of the panel P.

Figure 2:
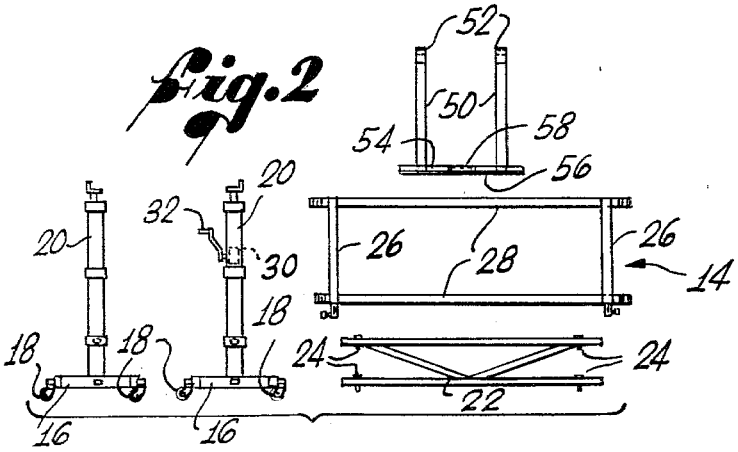
FIG. 2 is a plan view of the components of the apparatus in a disassembled condition.

It will be appreciated that the apparatus 10 is highly effective for positioning both ceiling and wall panels. It is light weight, fully mobile and can be operated by a single worker. In addition, it is small enough that, with the foot members 16 fully contracted, the holder 14 in its loading position, and the stanchions 20 contracted, it can easily fit through standard doorways. Moreover, the entire apparatus 10 is easily disassemblable into separate components as shown in FIG. 2. Thus, the holder 14 can be disconnected from the stanchions 20 by removing the pivot pins 44, and the stanchions can be separated by detaching the center section 22 and disconnecting one of the cables 36'. When disassembled in this manner, the entire apparatus 10 is easily carried in a small vehicle.

While a particular form of the invention has been illustrated and described, it will be apparent that various modifications can be made without departing from the spirit and scope of the invention.

I claim:

1. An apparatus for raising and positioning a panel for attachment to a horizontal or vertical interior surface of a building comprising:

a movable frame including a pair of parallel horizontal foot members each of which is horizontally extensible, a pair of stanchions each of which is vertically extensible and each of which projects upwardly from one of said foot members, and a detachable center section extending between said stanchions;

crank means for extending or contracting said stanchions;

a panel holder mounted atop said stanchions and pivotable about a horizontal axis extending perpendicular to said foot members between a generally vertical loading position and a generally horizontal working position;

locking means for securing said holder in said working position;

a plurality of rollers mounted on said holder to movably support said panel when said holder is in said working position;

support means mounted on said holder for supporting said panel along a lower edge thereof when said holder is in said loading position, said support means being movable between a panel-engaging position and a non-panel-engaging position; and hanger means mountable on said holder and engagable with one of said stanchions in a generally vertical position parallel to said foot members for supporting said panel in a generally vertical working position.

* * * * *